US006846788B2

(12) United States Patent
Everson et al.

(10) Patent No.: US 6,846,788 B2
(45) Date of Patent: Jan. 25, 2005

(54) METHODS FOR REMOVING SILVER-OXIDE

(75) Inventors: Terrence P Everson, Eagan, MN (US); Bryan Anderson, St Paul, MN (US)

(73) Assignee: Ecolab Inc., St. Paul, MN (US)

( * ) Notice: Subject to any disclaimer, the term of this patent is extended or adjusted under 35 U.S.C. 154(b) by 314 days.

(21) Appl. No.: 09/876,294

(22) Filed: Jun. 7, 2001

(65) Prior Publication Data

US 2003/0004073 A1 Jan. 2, 2003

(51) Int. Cl.[7] ..... C11D 17/00
(52) U.S. Cl. ..... 510/169; 510/202; 510/508; 510/509; 134/41
(58) Field of Search ..... 510/169, 202, 510/508, 509

(56) References Cited

U.S. PATENT DOCUMENTS

| | | | | |
|---|---|---|---|---|
| 2,691,593 A | | 10/1954 | Avedikian | 106/5 |
| 4,010,086 A | | 3/1977 | Barrett et al. | 204/141.5 |
| 4,116,629 A | | 9/1978 | Gancy et al. | 422/13 |
| 4,277,556 A | | 7/1981 | Koboshi et al. | 430/393 |
| 4,640,713 A | | 2/1987 | Harris | 106/3 |
| 4,643,361 A | | 2/1987 | Chapman | 241/16 |
| 4,678,597 A | | 7/1987 | Kiener | 252/100 |
| 4,755,453 A | | 7/1988 | Kunda et al. | 430/398 |
| 5,118,356 A | | 6/1992 | Darmon et al. | 134/3 |
| 5,198,141 A | | 3/1993 | Darmon et al. | 252/142 |
| 5,266,121 A | | 11/1993 | Cioletti | 134/3 |
| 5,614,027 A | | 3/1997 | Dunn et al. | 134/2 |
| 5,641,614 A | * | 6/1997 | Yamaya et al. | 430/399 |
| 5,795,851 A | | 8/1998 | Gerling et al. | 508/307 |
| 5,968,881 A | | 10/1999 | Haeggberg et al. | 510/226 |
| 5,990,071 A | | 11/1999 | Shubkin | 510/412 |
| 6,083,892 A | | 7/2000 | Severns et al. | 510/220 |
| 6,143,707 A | | 11/2000 | Trinh et al. | 510/220 |
| 6,143,713 A | | 11/2000 | Littig et al. | 510/520 |

* cited by examiner

*Primary Examiner*—Necholus Ogden
(74) *Attorney, Agent, or Firm*—Merchant & Gould P.C.

(57) ABSTRACT

The present invention is directed to compositions for removing silver soil from the surface of objects. These compositions contain a reducing agent, and an alkaline source, and may optionally contain various other components including a chelating agent, cleaning agent, filler, an anti-corrosion agent, a defoaming agent, an odorant, a dye, an antioxidant, or a bleaching agent. Methods of using the compositions are also disclosed, wherein the object to be cleaned is contacted with the composition and the object is then washed with an aqueous solution.

9 Claims, No Drawings

METHODS FOR REMOVING SILVER-OXIDE

FIELD OF THE INVENTION

The present invention relates to compositions and methods for removing silver oxide and silver sulfide from surfaces. More particularly, the invention relates to compositions containing a reducing agent and an alkali source and methods of using such compositions by contacting an object to be cleaned with the composition.

BACKGROUND OF THE INVENTION

Silver oxide, silver sulfide, and other silver by-products ("silver soils") build-up, in photofinishing equipment. In modem photofinishing, an automated process uses at least three separate tanks and associated solutions: a developer tank containing the developer solution that reduces the silver in the latent image to metallic silver, a fixer tank containing a fixer solution to remove undeveloped silver halide salts, and a wash tank containing a wash bath to remove residual fixer. These tanks are connected by a mechanized conveyance system, such as rollers, belts, and/or racks, to carry the photographic material between the tanks. After use of such automated processors, silver soils accumulate on the equipment thereby affecting the processor performance.

These silver soil deposits may contain silver, silver salts, silver oxide and silver sulfide. In the past, cerium solutions have been suggested, to clean silver soil U.S. Pat. No. 5,198,141. Various other solutions have also been used including bleach, chromic acid, sulfuric acid, and citric acid. See e.g. U.S. Pat. No. 4,678,597; U.S. Pat. No. 4,640,713. These solutions may require several hours of soaking and manual scrubbing to effectively remove silver soil. As a result, the intricate equipment, such as the conveyance system and trays, is often disassembled and manually or ultrasonically cleaned. Disassembly methods are not only time-consuming and labor-intensive, but they may lead to a host of mechanical problems.

Tarnish removers also remove silver soils in the form of tarnish, which is a film discoloration of a metal surface that is a result of a chemical reaction of oxygen and sulfur from the atmosphere with the metal surface. The prior art silver soil removers, such as those disclosed in U.S. Pat. No. 2,691,593, typically use an abrasive material, a carrier and a surfactant.

SUMMARY OF THE INVENTION

In accordance with the purpose(s) of this invention, as embodied and broadly described herein, this invention, in one aspect, relates to a cleaning composition, wherein the composition includes a reducing agent and an alkaline source, wherein the cleaning composition provides for improved silver soil removal.

In yet another aspect, the invention provides a method of removing silver soil from the surface of an object including: (a) immersing the object in a composition containing a reducing agent, an alkaline source, and an aqueous solution; and (b) washing the object with an aqueous solution. A further aspect of the invention includes this method directed to removing silver soil from the surface of a photoprocessing rack.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE PREFERRED EMBODIMENTS

The present invention may be understood more readily by reference to the following detailed description of preferred embodiments of the invention and the Examples included therein and their previous and following description.

Before the present compounds, compositions, articles, devices, and/or methods are disclosed and described, it is to be understood that this invention is not limited to specific synthetic methods of using or making as such may, of course, vary. It is also to be understood that the terminology used herein is for the purpose of describing particular embodiments only and is not intended to be limiting.

In this specification and in the claims that follow, reference will be made to a number of terms which shall be defined to have the following meanings:

Reference in the specification and concluding claims to parts by weight of a particular element or component in a composition or article, denotes the weight relationship between the element or component and any other elements or components in the composition or article for which a part by weight is expressed.

As used herein, the term "silver soil" means silver in any oxidation state, silver salts, silver oxide, silver sulfide and like silver by-products.

One embodiment of the present invention is a cleaning composition having improved silver oxide and silver sulfide soil removal capacity, wherein the composition comprises: elemental aluminum in zero oxidation state, and an alkaline solution, wherein the cleaning composition provides for improved silver oxide and silver sulfide soil removal.

Reducing Agent

The cleaning composition contains a reducing agent. Any reducing agent that oxidizes the silver soil may be used, including but not limited to, aluminum, beryllium, lithium, magnesium and manganese. The reducing agent maybe in any oxidation state, including elemental form. The reducing agent may also be in any physical form including, but not limited to solid forms such as rod, a bar, turnings, powder, or a sheet.

The amount of reducing agent useful in the present invention is determined by the surface area to be cleaned and the amount of silver soil to be removed. In practice, the amount of reducing agent is in excess so that the silver soil is the limiting reagent. It is believed that the silver soils and reducing agent, such as alumnimum, react in accordance with Schemes I and II.

Scheme I $$2AgO + 2H^+ + 2e^- \rightleftharpoons Ag_2O + H_2O$$

Scheme II $$Ag_2O + H^+ + 2e^- \rightleftharpoons 2Ag + OH^-$$

Alkaline Source

The composition may contain any effective amount of the alkaline source. The amount of alkaline source useful in the present invention is not critical as long as, the solution that results from the composition has a pH greater than 7.0, desirably a pH greater than 7.5. It is preferred that the alkaline source comprises about 0.001% to 30% wt., more preferably 0.01% to 10% wt., even more preferably 0.02% to 5% wt. of the composition when diluted with water.

The alkaline source may be a homogeneous mixture containing more than one alkaline source. Any alkaline source may be used to produce the alkaline solution, including, but not limited to, alkali metal carbonates such as sodium carbonate, potassium carbonate, potassium carbonate dihydrate, potassium carbonate trihydrate, potassium bicarbonate, sodium bicarbonate, sodium carbonate decahydrate, sodium carbonate heptahydrate, sodium carbonate monhydrate, sodium sesquicarbonate and the souble salt and mixtures thereof; hydroxides such as ammonium hydroxide, sodium hydroxide, potassium hydroxide, lithium hydroxide, calcium hydroxide, magnesium hydroxide, ferrous hydroxide, zinc hydroxide, copper hydroxide, aluminum hydroxide, ferric hydroxide; metal silicate, metal borate, and the like. The alkaline source may be premixed with the reducing agent and/or other composition components or it may be mixed at the time of application to the object to be cleaned. As such, these alkaline sources may be used in any form including solid beads, dissolved in an aqueous solution, powder, or any combination thereof. These sources may also be impure such that minor impurities, for example bicarbonate, may be present.

Chelating Agent

The composition may also contain a chelating agent, which is useful for binding the free metal ions. Any suitable chelating agent may be used, such as an aminocarboxylic acid, a condensed phosphate, a phosphonate a polyacrylate, and the like. Preferably, the chelating agent is about 0.001% to 30% wt., more preferably 0.01% to 10% wt., even more preferably 0.01% to 5% wt. of the composition when diluted with water. Example aminocarboxylic acids include n-hydroxythyliminodiacetic acid, nitrilotriacetic acid ("NTA" available from Solutia), ethylenediaminetetra acetic acid ("EDTA"), N-hydroxyethyl-ethylenediaminetriacetic acid, diethylenetriamine pentaacetic acid ("DPTA"), and the like.

Condensed phosphates useful in the present composition include sodium and potassium orthophosphate, sodium and potassium pyrophophate, sodium tripolyphosphate, and the like.

Example phosphonates include 1-hydroxyethylidene-1,1-diphosphonic acid ("HEDP" available as Dequest 2010 from Monsanto); aminotri(methylenephosphonic acid) (available as Dequest 2000 from Monsanto or Briquest 301 from Albright and Wilson), diethylenetriaminepenta (methylenephosphonic acid) (available as Dequest 2060 or 2066 from Monsanto), hexamethylenediamine (tetramethylenephosphonicacid (commercially available as Dequest 2054 from Monsanto), ethylenediamine (tetra (methylenephosphonic acid)) (available as Dequest 2041 from Monsanto), bis(hexamethylene)triamine (pentamethylenephosphonic acid, and phosphorus acid. Preferably, the chelating agent is a phosphonate, more preferably, HEDP. The phosphonate is preferably present as an alkali metal salt.

Polycarboxylates suitable for use as chelating agents include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

The chelating agent may be premixed with the reducing agent and alkaline source and/or other composition components or it may be mixed at the time of application to he object to be cleaned. As such, these chelating agents may be used in any physical form including solid beads, dissolved in an aqueous solution, powder, or any combination thereof.

Additional Components

The composition may also contain a cleaning agent, filler, an anti-corrosion agent, a defoaming agent, an odorant, a dye, an antioxidant, or a bleaching agent. These additional components may be premixed with the reducing agent and alkaline source and/or other composition components or they may be mixed at the time of application to the object to be cleaned. As such, these additional components may be used in any physical form including solid beads, dissolved in an aqueous solution, powder, or any combination thereof.

A variety of cleaning agents may be used including, but not limited to, anionic surfactants, nonionic surfactants, cationic surfactants, and zwitterionic surfactants. Anionic surfactants useful in the present invention include, but are not limited to carboxylates, sulfonates, sulfates, and phosphate esters. Example nonionic surfactants include those having a polyaklylene oxide polymer as a portion of the surfactant molecule. Such nonionic surfactants include halogen and alkyl polyethylene glycol ethers of fatty alcohols, polyalkylene oxide-free nonionics, carboxylic acid esters, carboxylic amides, silicone surfactants, and polyalkylene oxide block copolymers. Cationic surfactants suitable for use in the present composition include amines and quaternary ammonium salts. Desirably the surfactant is about 0.01% to about 0.05% wt., more desirably from about 0.01% to about 0.03% wt. of the composition.

The cleaning composition may also include a minor but effective amount of a filler which enhances the overall cleaning capacity and/or cost effectiveness of the composition. Any suitable filler may be used, such as sodium sulfate, sodium chloride, starch, sugars, glycols and the like. Desirably, the filler is about 0%–30% wt., more desirably from about 0% to about 10% wt. of the composition.

The present composition may also include low levels of an anti-corrosion agent to prevent damage to metal surfaces. Suitable anti-corrosion agents include water soluble metal ions, such as chlorides, nitrates and sulfates of magnesium and/or zinc ions; metasilicate, silicate, bismuth salts, manganese salts, paraffin, triazoles, pyrazoles, thiols, mercaptans, aluminum fatty acids, and mixtures thereof. If the alkalinity source is an alkali metal carbonate, bicarbonate or mixture, the anti-corrosion agent is preferably magnesium oxide and/or zinc oxide. To provide dispersibility of such metal ions in the composition, a carboxylated polymer, such as a water-soluble carboxylic acid polymer like polyacrylic and polymethacrylic acid or vinyl addition polymer like maleic anhydride copolymers, may be added. Desirably, the amount of this component is about 0% to about 10% wt. in the composition.

A minor but effective amount of a defoaming agent may also be present in the composition, for reducing the stability of foam. Example defoaming agents include silicone compounds, fatty amides, hydrocarbon waxes, fatty acids, fatty esters, fatty alcohols, fatty acid soaps, ethoxylates, mineral oils, polyethylene glycol esters, and the like. Desirably, the amount of this component is about 0% to about 5% wt. in the composition.

Various dyes, odorants including perfumes, and other aesthetic enhancing agents may also be included in the composition. Suitable dyes include any formulation that alters the appearance of the composition. Fragrances or perfumes that may be included include terpenoids, aldehydes, jasmine, vanillin, and the like. Desirably, the amount of this component is about 0% to about 5% wt. in the composition.

Articles that may be cleaned with the present composition include metal surfaces, such as stainless steel, carbon steel, titanium and silver, as well as plastics.

Other additives may be used depending on the desired final form of the composition. For example, thickeners such as synthetic polymers, fatty acids, fatty acid salts and esters, fatty alcohols, modified celluloses or modified mineral materials can also be employed with liquid carriers to form spreadable pastes and gels for application directly to the surface of the object to be cleaned. Similarly, a coating containing water-soluble polymeric materials and/or a hardening agent such as an amide, alkylamide, solid glycol, or starch may be employed if the final form is a tablet, pellet, block, or bead.

Form/Delivery

The composition may be in any form suitable for the desired delivery method. Example forms include a premixed composition wherein the reducing agent and alkaline source and/or other composition components are premixed with or without an aqueous solution such as to form a solid or liquid product. One or more of the components may also be mixed at the time of application to the object to be cleaned. As such, any of the components may be used in any form including solid beads, liquid, powdered, agglomerated, pelleted, or any combination thereof. The composition may be processed using conventional processing materials.

One exemplary form is a premixed powder with an aluminum bar, rod or sheet. Another exemplary form is a mixture of solid aluminum and all other components in a liquid medium processed in a minor but effective amount of an aqueous medium, such as water, to substantially blend and solubilize these components and achieve a homogenous mixture.

The amount of the composition used in the cleaning treatment will vary not only with the particular components selected but also with the route of delivery, the amount of silver soil to be removed, and the surface area of the silver soil. In general, however, a suitable dose will be in the range of from about 0.005% to about 1% wt. of the composition in the use solution. Theoretically, the composition's concentration is about 5 to 10,000 ppm in the use solution.

Composition Use

The present composition is useful in silver soil removal applications, X-ray applications, photographic processing, silver processing and other imaging media. Therefore, objects to be cleaned may be composed of a variety of materials including metal such as silver, carbon steel, stainless steel, nickel, titanium, and copper, as well as plastic and rubber such as polypropylene, polyethylene, nylon, TEFLON, acrylonitrile butele styrene, polyvinyl chloride, EPDM, polycarbonate, polyurethane, polyacrylate, polystyrene, and polyester.

The composition may be used to remove silver soil from the surface of an object by applying the composition directly onto the object. Particularly suitable forms/delivery methods for such an application include gels or pastes.

Another suitable method of using the composition includes immersing the object to be cleaned in a composition comprising a reducing agent, such as elemental aluminum in zero oxidation state, an alkaline source, such as sodium carbonate, and an aqueous solution, such as water; and washing the object with an aqueous solution. In such an application, the alkaline source may be added to the aqueous solution before immersion of the object and the reducing agent may be added before or after immersion of the object. This method may be used as a clean-in-place cleaning regimen, where the solution is introduced into the equipment as assembled, or as a clean-out-of-place cleaning regimen, where the equipment is disassembled and inserted into basins containing the cleaning solution.

The reducing agent, alkaline source and any other composition components are added together with the accurate solution such that, the pH of the resulting solution stays within the alkaline range. The temperature of the resulting solution may be any suitable temperature including room temperature to about 80° C. Higher temperatures speed the chemical reaction. Similarly, electricity may be conducted through the system to speed the chemical reaction; however, electricity is not necessary to allow the chemical reaction to proceed.

The object to be cleaned may remain in contact with the composition for any amount of time as long as the removal of silver soil is effective. The amount of time will of course depend on the concentration of the composition, the route of delivery, the amount of silver soil to be removed, and the surface area of the silver soil. For example, the composition is in contact with the object for about 30 to 120 minutes, when the immersion technique is used.

Movement of the composition may be employed while it is in contact with the object. Suitable types of movement include scrubbing, agitation, air sparging, or effervesce. Such movements may speed the reaction by increasing the surface area of the silver soil and may also increase the effectiveness especially with respect to intricate parts.

After contact with the composition, preferably the object is contacted with an aqueous solution, such as water. The object may be sprayed, immersed, wiped or have water applied in any known method.

Experimental

The following examples are put forth so as to provide those of ordinary skill in the art with a complete disclosure and description of how the compounds, compositions, articles, devices, and/or methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric.

EXAMPLE 1

A 1:1 wt mixture of sodium carbonate and 1-hydroxyethylidene-1,1-diphosphonic acid (HEDP) was prepared. This mixture was dissolved to obtain a 1.5% solution in luke warm water (about 50° F.). A sheet of aluminum foil was laid at the bottom of the basin and the solution was added to the basin. A photoprocessing rack made from stainless steel and plastic with silver soil on the surface was inserted into the basin, such that a portion of the rack was not in contact with the solution. The rack remained in the solution for approximately two hours, upon which time it was removed and rinsed with water. Substantially all of the silver soil was easily removed from the rack with the water rinse and/or with slight mechanical action following the water rinse. Throughout this application, various publications are referenced. The disclosures of these publications in their entireties are hereby incorporated by reference into this application in order to more fully describe the state of the art to which this invention pertains.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of removing silver soil from the surface of an object comprising:

(a) contacting the object with a composition comprising a reducing agent, an alkaline source, and an aqueous solution, wherein the composition has a pH greater than 7.0; and (b) rinsing the object with an aqueous solution.

2. The method of claim 1, wherein the object comprises stainless steel, carbon steel, titanium, silver, polypropylene, polyethylene, nylon, polytetrafluoroethylene fluorocarbon polymer, fluorinated ethylene-propylene resin, acrylonitrile butele styrene, polyvinyl chloride, ethylene-propylene terpolymer, polycarbonate, polyurethane, polyacrylate, polystyrene, or polyester.

3. The method of claim 2, wherein the object is photoprocessing equipment.

4. The method of claim 1, further comprising scrubbing, agitation, air sparging, or effervesce of the composition.

5. A method of removing silver soil from the surface of a photoprocessing rack comprising stainless steel, wherein the method comprises:

(a) contacting the rack with a composition comprising a reducing agent, an alkaline source, and an aqueous solution, wherein the composition has a pH greater than 7.0;

(b) allowing the composition to agitate while in contact with the rack; and (c) rinsing the rack with an aqueous solution.

6. The method of claim 5, wherein the reducing agent is elemental aluminum.

7. The method of claim 5, wherein the composition has a pH above 7.5.

8. The method of claim 5, wherein the composition further comprises a chelating agent.

9. The method of claim 8, wherein the chelating agent is 1-hydroxyethylidene-1,1-diphosphonic acid.

* * * * *